United States Patent [19]

Tontarelli

[11] Patent Number: 4,714,183

[45] Date of Patent: Dec. 22, 1987

[54] PLASTIC HANGER WITH A GROOVED CIRCULAR CROSS-SECTION

[76] Inventor: Sergio Tontarelli, Via Giolitti 62-San Rocchetto, Castelfidardo, Italy

[21] Appl. No.: 933,111

[22] Filed: Nov. 21, 1986

[51] Int. Cl.[4] ..... A47G 25/28

[52] U.S. Cl. ..... 223/91; 223/85; D6/319

[58] Field of Search ..... 223/91, 92, 93, 89, 223/85, 88; 211/113; D6/319, 317

[56] References Cited

U.S. PATENT DOCUMENTS

| | | | |
|---|---|---|---|
| D. 149,517 | 5/1948 | Read | D6/319 |
| 2,370,391 | 2/1945 | Bolten et al. | 211/113 X |
| 2,587,743 | 3/1952 | Mackey | D6/319 X |
| 2,634,031 | 4/1953 | Klein | 223/88 |
| 3,289,901 | 12/1966 | Zwanzig | 223/88 |
| 3,524,226 | 8/1970 | Brown | 223/85 |
| 4,066,193 | 1/1978 | Davis, Jr. | 223/88 |
| 4,382,531 | 5/1983 | Bisk et al. | 223/93 X |
| 4,416,401 | 11/1983 | King | 223/88 |
| 4,474,316 | 10/1984 | Philibert | 223/85 X |
| 4,556,158 | 12/1985 | Blanchard et al. | 223/88 |

*Primary Examiner*—Andrew M. Falik

*Attorney, Agent, or Firm*—Leonard Bloom

[57] ABSTRACT

A unitary molded-plastic hanger is intended for multiple purposes. The hanger includes: (1) a frame or body portion adapted for holding a coat, etc.; (2) a lower horizontal cross bar provided with slidably adjustable pegs for holding trousers; (3) a pair of L-shaped molded brackets within the frame, the brackets having laterally-extending upturned ends disposed above the cross bar for holding a shirt or the like; (4) and a molded bracket integrally joined with one of the L-shaped brackets and disposed substantially centrally of the frame for holding ties. The hanger has a pair of V-shaped diametrically-opposed slots formed therein continuously thereof, and the pegs on the cross bar have respective opposed teeth engaged in the V-shaped slots, respectively, thereby precluding substantial relation of the pegs relative to the cross bar.

6 Claims, 5 Drawing Figures

1A
1B
1C
1D
1E
1F
1
2
2A
2B
2C
2D
4
5

PLASTIC HANGER WITH A GROOVED CIRCULAR CROSS-SECTION

FIELD OF THE INVENTION

The present invention relates to a hanger, and more particularly, to a unitary integrally-molded plastic hanger intended for multiple usage.

BACKGROUND AND SUMMARY OF THE INVENTION

The prior art, while teaching hangers for multiple purposes, nevertheless suffers from certain disadvantages and deficiencies.

Accordingly, the present invention relates to a unitary integrally-molded plastic hanger, and more particularly, to a molded plastic hanger having a rather flattened trapezoid shape, characterized by various internal appendixes, which allow for all possible uses. As a result, the hanger can be used for shirts, trousers, skirts, ties and belts.

The hanger according to the invention is provided with a cross bar having two pegs slidably mounted therein and designed to hold the hem of trousers, when one wishes to hang them straight, rather than folded over the lower bar in the conventional manner.

The hanger of the present invention further includes a monobloc, plastic-molded frame, with a circular cross-section having a double stiffening channel which runs along the entire hanger, and a wider, grooved surface where clothes and/or accessories will rest, thus giving more resting space. As a result, the garments being hung will encounter more friction and will not fall from the hanger because of their own weight.

By means of a double lateral channelling on a circular section hanger frame, the frame becomes stiffer, and there is a certain saving on the amount of the material used. Also, during manufacture, the molded piece cools more rapidly, which allows a higher molding speed.

For clarity, the descripton of the invention now continues with reference to the attached drawings, shown merely for illustrative purposes, and not restrictive, where:

DESCRIPTION OF THE PREFERRED EMBODIMENT

Figures 1, 2, 3, 4, 5:
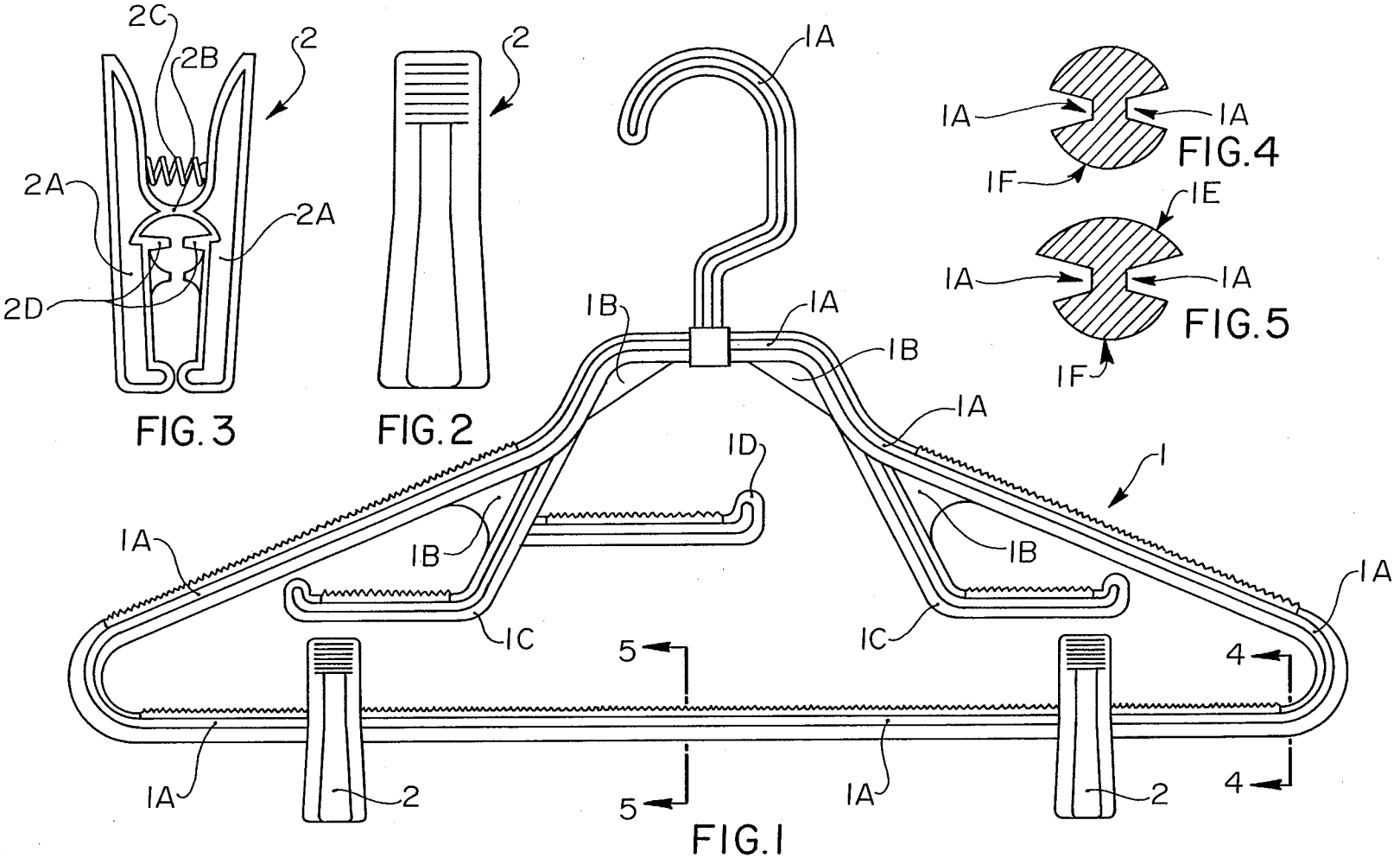
FIG. 1 is a front view of the hanger according to the invention.
FIG. 2 is a back view of the peg attached to the hanger according to the invention.
FIG. 3 is a side view of the peg attached to the hanger according to the invention.
FIG. 4 is a section on the line 4—4 of FIG. 1.
FIG. 5 is a section on the line 5—5 of FIG. 1.

With reference to FIG. 1, the hanger includes a frame or body portion (1), the outline being that of a flattened isosceles trapezium, molded in one piece, in plastic, and having a circular cross-section.

Two identical channels (1*a*), diametrically opposed and "V"-shaped, run along the entire frame (1) which is stiffened by some gussets (1*b*).

On the inside, the frame (1) has two small symmetrical brackets (1*c*), L-shaped and with the free ends turned outwards, made to hold the loops which are usually sewn to skirt-waists.

Still on the inside of the frame (1) stemming from one of the two symmetric appendixes (1*c*), there is a further small bracket (1*d*) which can be used as a hook for ties or belts.

It should be noted that the frame (1) has a wider, grooved surface in those places where the various garmets should rest, so that the perimeter of the cross-section in these segments of the frame, as shown in FIG. 5, has an upper arc (1*e*) with a wider diameter in comparison to that of the lower arc (1*f*); the two arcs (1*e* and 1*f*) are connected by the double lateral channelling (1*a*) mentioned above.

As previously stated, the hanger in question is equipped with two pegs (2), each of which consists of two identical and symmetrical jaws (2*a*), molded in plastic and connected to each other by means of an intermediate flexible and elastic tongue (2*b*) which acts as a hinge between the jaws themselves.

A helicoidal spring (2*c*) is interposed between the jaws (2*a*) and holds the grasping ends of the jaws tightly one against the other.

There are identical, opposite teeth (2*d*) inside the two jaws (2*a*) near said tongue (2*b*), and placed on the grasping ends of the peg (2).

These teeth (2*d*) are of such shape and size as will allow them to fit into the opposed channels (1*a*) on the frame (1), with an amount of play sufficient to allow said pegs to slidably move along said channels without any rotation.

I claim:

1. A unitary integrally-molded plastic hanger intended for multiple usage, comprising a molded plastic frame, the frame having two substantially identical and diametrically opposed side channels formed therein, the channels being substantially "V"-shaped and running along the entire frame, the frame including a lower horizontal cross bar having a substantially circular cross-section provided with said side channels formed therein, thereby defining an upper arc and a lower arc intermediately of the channels, and the upper arc being formed on a radius which is larger than the radius forming the lower arc.

2. A unitary integrally-molded plastic hanger intended for multiple usage, comprising a molded plastic frame having a substantially circular cross-section including a pair of diametrically-opposed side channels formed therein, thereby stiffening the frame, reducing material, and facilitating faster cooling of the molded plastic hanger, the channels running substantially along the entire frame, the frame including a lower horizontal cross bar, the frame further having an inner portion provided with two substantially identical and symmetrical L-shaped brackets, the brackets being disposed within the inner portion of the frame and extending laterally thereof above the cross bar, and the brackets having respective free ends turned outwardly, whereby shirts or the like may be supported on the respective brackets.

3. The unitary integrally-molded plastic hanger of claim 2, wherein a hook is formed integrally with the frame and extends therefrom above the frame, and wherein a small further bracket is disposed on the inside of the frame, the small bracket being formed integrally with one of the L-shaped brackets and extending therefrom between the hook and the cross bar substantially centrally of the frame, whereby a tie may be supported on the small bracket.

4. A unitary integrally-molded plastic hanger intended for multiple usage, comprising a molded plastic frame including a lower horizontal cross bar having a substantially circular cross-section and further having a pair of substantially diametrically-opposed longitudinal side stiffening channels formed therein, a pair of pegs slidably mounted on the cross bar, the pegs each having spring-loaded gripping jaws, whereby trousers may be supported on the hanger, the pegs each further having opposed teeth received in the channels on the cross bar, thereby allowing the pegs to be slidably adjustable along the cross bar while precluding substantial rotation of the pegs relative to the cross bar.

5. A unitary integrally-molded plastic hanger intended for multiple usage, and comprising, in combination, a body portion adapted to support a coat or the like and including a hook extending above the body portion and formed integrally therewith, the body portion further including a horizontal cross bar disposed below the body portion and formed integrally therewith, the body portion, hook and cross bar having a substantially circular cross-section and further having a pair of substantially continuous diametrically-opposed substantially Vee-shaped side channels formed therein, therby accelerating the cooling of the hanger during the plastic molding thereof, while saving material, yet providing a stiffening of the body portion of the hanger, the circular cross-section of the cross bar having upper and lower arcs, wherein the upper arc has a larger radius than the radius forming the lower arc, a pair of pegs slidably mounted on the cross bar, the pegs each having spring-loaded gripping jaws, whereby trousers may be supported on the hanger, the pegs each further having opposed teeth received in the side channels on the cross bar, thereby allowing the pegs to be slidably adjustable along the cross bar while precluding substantial rotation of the pegs relative to the cross bar, and the body portion further including a pair of integrally-molded substantially L-shaped brackets having outwardly-turned laterally-extending end portions disposed above the cross bar, whereby a shirt may be supported on respective end portions of the L-shaped brackets.

6. The combination of claim 5, wherein at least one of the L-shaped brackets has a small further bracket formed integrally therewith and extending therefrom towards the other bracket substantially between the hook and the cross bar and centrally of the main body portion, whereby a tie may be supported on the small bracket.

* * * * *